US006397706B1

(12) United States Patent
Maznicki

(10) Patent No.: US 6,397,706 B1
(45) Date of Patent: Jun. 4, 2002

(54) PROTECTIVE SOCKETS

(75) Inventor: Peter J. Maznicki, Somers, CT (US)

(73) Assignee: Protective Sockets Company LLC, Enfield, CT (US)

( * ) Notice: Subject to any disclaimer, the term of this patent is extended or adjusted under 35 U.S.C. 154(b) by 53 days.

(21) Appl. No.: 09/606,879

(22) Filed: Jun. 29, 2000

Related U.S. Application Data

(63) Continuation-in-part of application No. 09/397,228, filed on Sep. 16, 1999, now abandoned

(60) Provisional application No. 60/123,376, filed on Mar. 8, 1999.

(51) Int. Cl.[7] ..... B25B 13/06

(52) U.S. Cl. ..... 81/121.1; 81/185

(58) Field of Search ..... 81/121.1, 124.6, 81/124.7, 185, DIG. 11, 900

(56) References Cited

U.S. PATENT DOCUMENTS 2,322,856 A 6/1943 Le Roue
3,433,108 A 3/1969 Ondeck
4,145,939 A 3/1979 Garrison
4,979,355 A 12/1990 Ulevich
5,970,826 A 10/1999 Iwinski et al.
6,029,547 A 2/2000 Eggert et al.

*Primary Examiner*—Eileen P. Morgan
*Assistant Examiner*—Joni B. Danganan
(74) *Attorney, Agent, or Firm*—McCormick, Paulding & Huber LLP

(57) ABSTRACT

A socket adapted to torque a head of a hardware fastener is presented. The hardware having a predetermined size and an associated counter bore with a predetermined diameter per the SAE Standard cited as: "Wrench Clearance, Table 3, SAE Aeronautical Drafting Manual, 1954 edition, page Y4.04". The socket comprises a drive portion adopted to engage a socket drive tool, and a hardware portion attached to the drive portion. The hardware portion includes a metallic outer sleeve having an outside diameter which is sized to fit into the associated counter bore of the hardware, and a non-marring inner lining disposed within the outer sleeve. The inner lining includes a hardware torquing hole located at a distal end of the socket, and sized to fit over the head of the hardware to provide torquing to the hardware without marring the hardware.

18 Claims, 1 Drawing Sheet

PROTECTIVE SOCKETS

CROSS-REFERENCE TO RELATED APPLICATION

This application is a continuation in part of U.S. application Ser. No. 09/397,228, filed on Sep. 16, 1999, now abandoned, which claims priority to the Provisional Application which was filed on Mar. 8, 1999, as application Ser. No. 60/123,376.

BACKGROUND OF THE INVENTION

The present invention relates generally to sockets for tooling, e.g., socket wrenches, torque wrenches or air wrenches, used to apply torque to hardware, e.g., nuts or bolts, in an assembly process. More specifically, the present invention relates to a protective socket which prevents marring and/or damaging hardware or components being assembled when torque is applied.

Sockets and their associated tooling are used in a wide variety of applications throughout many different industries to assemble and attach various components by applying torque to hardware to hold the components together. The sockets themselves are generally constructed of a metal, such as steel, capable of applying the proper torque to the hardware without deformation. However, when torque is applied, the socket can damage or mar the hardware or the components being assembled. That is, the corners on the head of a nut or bolt can be rounded off, the paint or coating can be damaged or scraped off the hardware, or the component itself can be scraped or scratched as the socket twists against its surface.

In many industries, e.g., aircraft, automotive, ship building, medical equipment and nuclear, the damage and marring caused by torquing, i.e., tightening or loosening, the sockets requires corrective action. By way of example, in the aircraft industry, damage caused by torquing prior art sockets to the required load may result in the following problems: (1) damaged hardware or components are considered a safety hazard and must be replaced; (2) chipped or damaged protective finishes on various hardware or components are considered contamination in aircraft critical areas or a safety hazard; (3) aircraft quality control standards require aircraft manufacturers to initiate costly and time consuming material review procedures to identify damaged components or hardware bolts and determine proper corrective action; and (4) corrective action procedures often require aircraft manufacturers to disassemble and strip the protective coating from damaged components or hardware, then recoat and reassemble. It is very common for these corrective action procedures to be repeated numerous times during the assembly process.

Various non-metallic sockets, e.g., nylon, Teflon®, or other polymeric materials, have been utilized in an attempt to prevent the marring and damaging caused by metallic sockets. However, these non-metallic sockets require a larger outside diameter than the metallic sockets in order to obtain the strength necessary to apply the proper torque to the hardware during an assembly process. These larger outside diameters prevent the non-metallic sockets from fitting inside standard counter bores associated with the hardware, e.g. a ⅜ inch bolt requires 0.620 inch diameter counter bore and ¾ inch bolt requires a 1.120 inch diameter counter bore. On the other hand, if the non-metallic sockets outside diameter were made small enough to fit into the counter bores they would lack the strength of the metallic sockets and deform or slip when applying torque to the hardware.

The accepted US standard for counter bore diameters for conventional socket wrenches, e.g. detachable socket wrenches with ¼ inch and ⅜ inch square drives for hand use (manufactured to standard ASME B107.1-1993), is cited as follows: "Wrench Clearance, Table 3, SAE Aeronautical Drafting Manual, 1954 edition, page Y4.04" (hereinafter the "SAE Standard"). The standard is published by the SAE INTERNATIONAL, 400 Commonwealth Drive, Warrendale, Pa. 15096-0001. Column "A" of the SAE Standard gives the associated minimum counter bore diameters required to receive the nut drive end of the above referenced socket wrenches. The SAE Standard has been adopted and used by the machinery industry for many years and is printed in the 25th Edition of the "Machinery Handbook", published by Industrial Press, Inc., New York, N.Y. (hereinafter the "Machinery Handbook"). Column "A" of the SAE Standard is printed as column "K" on page 1436 of the Machinery Handbook in Table 2, titled "Wrench Clearances for Open End Wrench 15 degrees and Socket Wrench (Regular Length)". The socket wrench hardware sizes and associated minimum counter bore diameters of Column "A" of the SAE Standard are reprinted in the following table:

| Hardware size (inches) | Minimum Counter Bore Diameter (inches) |
|---|---|
| .188 | .370 |
| .250 | .470 |
| .312 | .550 |
| .344 | .580 |
| .375 | .620 |
| .438 | .750 |
| .500 | .810 |
| .562 | .870 |
| .594 | .920 |
| .625 | .950 |
| .688 | 1.030 |
| .750 | 1.120 |
| .781 | 1.150 |
| .812 | 1.200 |
| .875 | 1.280 |
| .938 | 1.370 |
| 1.000 | 1.470 |
| 1.062 | 1.550 |
| 1.125 | 1.610 |
| 1.250 | 1.890 |
| 1.312 | 1.980 |
| 1.438 | 2.140 |
| 1.500 | 2.200 |
| 1.625 | 2.390 |

One such prior art socket wrench having a non-marring insert is described in U.S. Pat. No. 3,433,108 to E. J. Ondeck (hereinafter the "Ondeck patent"). The Ondeck patent is directed to a socket wrench having a non-mar plastic insert having longitudinal side-walls adapted to fully engage a like number of side-walls in a wrench socket in sliding fit relationship and an inner cross-section having longitudinal side-walls. The insert has the same number of outer side-walls as the socket and the same number of inside walls as the nut with which it is used. The insert has 24 outside walls (or 12 corners mating with a conventional socket wrench) and provides in combination therewith six inside walls (or 6 points) for use with hexagonally headed nuts.

However, the problem of having a socket wrench with both a non-mar inner lining and an outside diameter which meets the SAE Standard is not solved by Ondeck. It is specifically stated in Ondeck that, once the insert is fit into a conventional socket wrench, e.g., one manufactured to standard ASME B107.1-1993 (inch series) or ASME B107.5M-1994 (metric series), than "the plastic liner or adaptor is constructed to cooperate with a nut slightly smaller in dimension than a nut properly fitting in the socket without the liner" (see Ondeck, column 3, lines 41–43). This is because the plastic non-mar liner of Ondeck would "flow" or deform if the soft plastic insert were to be made any thinner. Even with the combination of the conventional wall thickness of a standard socket wrench for added support, the soft plastic insert of Ondeck must have a geometric shape in which no voids exist between the inserts hexagonal inner surface and the nut to be engaged or plastic flow will occur and the insert will be damaged (see Ondeck, column 3, lines 24–28).

The problem in Ondeck, as in other non-mar prior art sockets, is that a non-marring inner lining must be inherently softer that the nut it is designed to engage in order to prevent marring. Therefore, the inner lining must rely on its outer sleeve for added support or the nut will damage the inner lining. A delicate balance must be struck between the hardness of the nuts to be engaged, the hardness and geometry of the non-mar inner lining, and the hardness and geometry of a socket's outer sleeve. This balance becomes all the more difficult and complex when the outside diameter of the socket wrench must also be limited to the SAE Standard for minimum counter bore diameters. It is also this balance which forces the dimensions of prior art sockets away from conventional socket wrench standards, such as ASME B107.1-1993 and ASME B107.5M-1994.

There is a need, therefore, for an improved non-mar socket wrench, which can also fit within the dimensional parameters of conventional socket wrench standards, such as the SAE Standard, ASME B107.1-1993 or ASME B107.5M-1994.

SUMMARY OF THE INVENTION

This invention offers advantages and alternatives over the prior art by providing a protective socket having an outer sleeve and an inner lining with dimensions which substantially meet conventional socket wrench standards, such as the SAE Standard, ASME B107.1-1993 or ASME B107.5M-1994. Advantageously, the outer sleeve reinforces the inner lining to provide the strength required to torque hardware during most assembly processes. Also, the outer sleeve is preferably sized to fit into the SAE Standard counter bores of the associated hardware being torqued and the inner lining preferably extends outwardly from a distal end of the outer sleeve. Additionally, the inner lining is pliable enough to prevent damaging or marring of the hardware or components being assembled. This advantageously reduces the reassembly, corrective action and safety hazards associated with the damaged and marred components and hardware. This results in significant assembly cost savings in industries with critical quality control standards, such as the aircraft industry, automotive or nuclear industry.

These and other advantages are accomplished in a preferred form of the invention by providing a socket adapted to torque a head of a hardware fastener. The hardware having a predetermined size and an associated counter bore with a predetermined diameter per the SAE Standard cited as: "Wrench Clearance, Table 3, SAE Aeronautical Drafting Manual, 1954 edition, page Y4.04". The socket comprises a drive portion adopted to engage a socket drive tool, and a hardware portion attached to the drive portion. The hardware portion includes a metallic outer sleeve having an outside diameter which is sized to fit into the associated counter bore of the hardware, and a non-marring inner lining disposed within the outer sleeve. The inner lining includes a hardware torquing hole located at a distal end of the socket, and sized to fit over the head of the hardware to provide torquing to the hardware without marring the hardware. Preferably, the inner lining has an M scale hardness of substantially 115 or greater and is comprised of a composite material.

In an alternative embodiment the socket has dimensions which substantially meet standard ASME B107.1-1993 (inch series). In another alternative embodiment the socket has dimensions which substantially meet standard B107.5M (metric series).

BRIEF DESCRIPTION OF THE DRAWINGS

The present invention will now be described, by way of example only, with reference to the accompanying drawings in which.

DETAILED DESCRIPTION OF THE PREFERRED EMBODIMENTS

Figure 1:
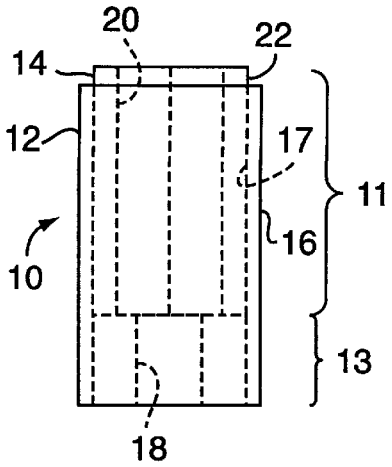
FIG. 1 is a side view of a protective socket of the present invention.
Figure 2:
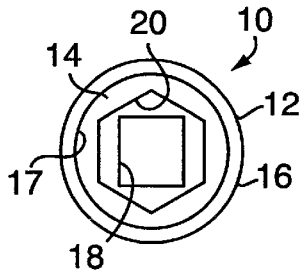
FIG. 2 is a top view of the hardware portion of the protective socket.
Figure 3:
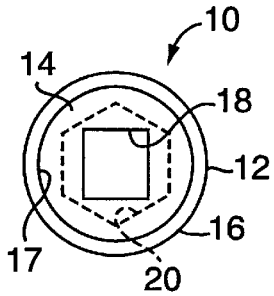
FIG. 3 is a bottom view of the drive portion of the protective socket.

Referring to FIGS. 1, 2 and 3, an exemplary embodiment of a protective socket for torquing hardware, e.g., nuts and bolts, of the present invention as shown generally at 10. Protective socket 10 comprises a hardware portion 11 adopted to engage the hardware to be torqued and a drive portion 13 adopted to engage a conventional socket drive tool (not shown), e.g., a ¼ inch, a ⅜ inch or a ½ inch hand socket drive tool. The hardware portion includes an outer sleeve 12 and an inner lining 14. Outer sleeve 12 is preferably constructed from a metallic material, e.g., stainless steel or hardened steel, to provide support for inner lining 14. Outer sleeve 12 has an outside diameter, indicated by arrow 16, sized to fit inside of standard counter bore holes of the associated hardware being torqued, e.g., counter bore holes sized to meet the SAE Standard. Outer sleeve 12 is shown, by way of example, as cylindrical in shape having a circular inside portion 17 and extending into the drive portion 13 of the socket 10. Inside portion 17 mates concentrically with inner liner 14 to provide support for inner liner 14 during the torquing process. One skilled in the art would recognize that inside portion 17 may comprise other shapes while still providing support to the inner lining. That is, inside portion 17 may have different shapes to provide different degrees of support for inner lining 14. Inner lining 14 would, in turn, modify its shape to mate with inside portion 17 and still provide a protective lining for hardware and components being assembled.

Inner lining 14 includes a hardware torquing hole 20. Hardware torquing hole 20 is shown, by way of example, as being hexagonal in shape having 6 points (or single hexagonal) to fit over a standard six-point hex head bolt or nut. However, one skilled in the art would recognize that hardware torquing hole 20 may comprise other shapes to fit over other types of hardware, e.g., double hexagonal, square or double square.

Inner lining 14 is preferably constructed from a composite material having an M scale hardness of substantially 115 or greater, e.g., NEMA grade G-10 glass cloth epoxy or NEMA grade G-3 glass cloth phenolic. The unique combination of the inner lining 14 supported by outer sleeve 12 provides the necessary strength and rigidity to apply the proper torque required to hardware in most assembly processes. Additionally, the inner lining 14 is pliable enough to prevent marring or damaging of the hardware being torqued or the components assembled.

In the exemplary embodiment shown, inner lining 14 further includes an extended portion 22 which extends outwardly from outer sleeve 12 at the distal end of protective socket 10 containing hardware torquing hole 20. Extended portion 22 prevents outer sleeve 12 from making contact with any component that socket 10 torques hardware onto. This provides additional protection to the surface of the component by ensuring that only the pliable inner lining 14 can make contact with the surface, thus preventing scraping or scratching of the component with the metal outer sleeve 12.

If the extended portion 22 extends outwardly from the distal end of the outer sleeve by more than a thickness of the head of the hardware (not shown), then the extended portion may deform or slip when applying torque to the hardware. That is, the head of the hardware will pull out of the outer sleeve as it is torqued flush to the surface of the component being torqued, and be supported solely be the inner lining. Therefore, in this exemplary embodiment, the extended portion extends outwardly from the distal end of the outer sleeve by a distance less then the thickness of the head of the hardware it is torquing.

The drive portion 13 includes the outer sleeve 12 extending up from the hardware portion, as well as a tool drive hole 18. Tool-drive hole 18 is sized to fit over the socket drive of a tool used to apply torque to the hardware being assembled. Tool drive portion 18 is shown, by way of example, as being generally square in shape and is sized to mate with a standard square socket drive, such as a ¼ inch, ⅜ inch or ½ inch drive. One skilled in the art would recognize that tool-drive hole 18 may comprise other shapes to fit over other socket drives, e.g., metric drives or nonstandard shaped drives.

Figure 4:
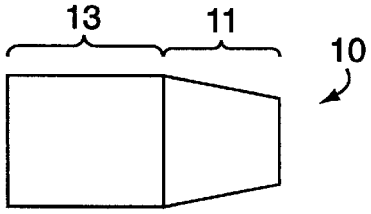
FIG. 4 is an alternative embodiment of the present invention which meets one of the standards ASME B107.1-1993 or ASME B107.5M-1994.
Figure 5:
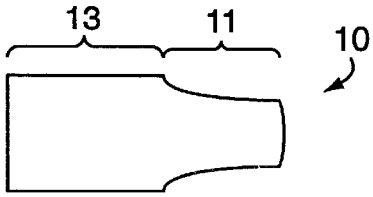
FIG. 5 is an alternative embodiment of the present invention which meets one of the standards ASME B107.1-1993 or ASME B107.5M-1994.
Figure 6:
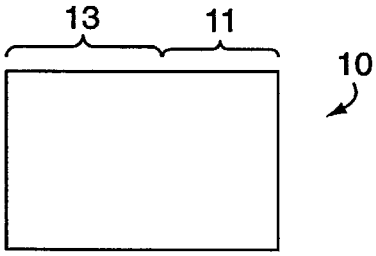
FIG. 6 is an alternative embodiment of the present invention which meets one of the standards ASME B107.1-1993 or ASME B107.5M-1994.
Figure 7:
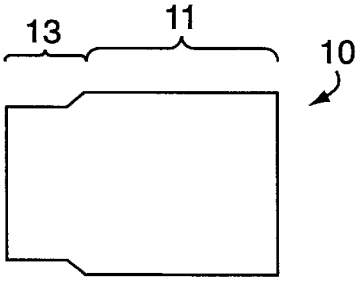
FIG. 7 is an alternative embodiment of the present invention which meets one of the standards ASME B107.1-1993 or ASME B107.5M-1994.

Referring to FIGS. 4–12, various alternative embodiments of the present invention are presented in which the sockets 10 are manufactured to one of the standards ASME B107.1-1993, Titled "Socket Wrenches, Hand (Inch Series); and ASME B107.5M-1994, Titled "Socket Wrenches, Hand (Metric Series). Both standards are published by the American Society of Mechanical Engineers. In FIGS. 4 and 5 the hardware portion 11 has a diameter which is smaller than the drive portion diameter. In FIG. 6 the outside diameter of the hardware portion 11 and the drive portion 13 are substantially equal. In FIG. 7 the hardware portion 11 has a diameter which is larger than the drive portion diameter.

Figure 8:
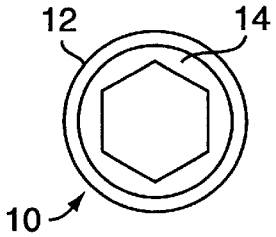
FIG. 8 is an alternative embodiment of the present invention which meets one of the standards ASME B107.1-1993 or ASME B107.5M-1994 and has a cross section of the hardware portion configured as a single hexagon.
Figure 9:
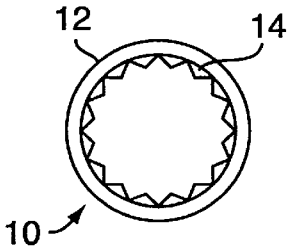
FIG. 9 is an alternative embodiment of the present invention which meets one of the standards ASME B107.1-1993 or ASME B107.5M-1994 and has a cross section of the hardware portion configured as a double hexagon.
Figure 10:
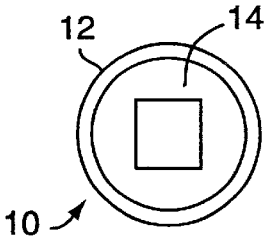
FIG. 10 is an alternative embodiment of the present invention which meets one of the standards ASME B107.1-1993 or ASME B107.5M-1994 and has a cross section of the hardware portion configured as a square.
Figure 11:
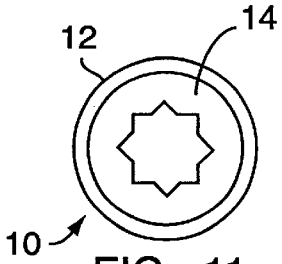
FIG. 11 is an alternative embodiment of the present invention which meets one of the standards ASME B107.1-1993 or ASME B107.5M-1994 and has a cross section of the hardware portion configured as a double square.

In FIGS. 8 and 9, the inner lining 14 is configured in the Class 1 single hexagon, and Class 1 double hexagon respectively of standard B107.1-1993. In FIGS. 10 and 11, the inner lining 14 is configured in the Class 2 square and Class 2 double square respectively of standard B107.1-1993. The different classes are designed to torque various hardware having different shaped heads. By way of example the Class 1 double hexagon can be used to torque a nut having a square head, hexagonal head, or double hexagonal head.

Figure 12:
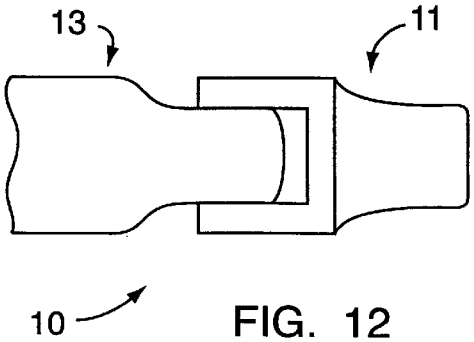
FIG. 12 is an alternative embodiment of the present invention which meets one of the standards ASME B107.1-1993 or ASME B107.5M-1994 and the hardware portion is pivotally attached to the drive portion.

In FIG. 12, socket 10 is a class 3 universal socket per ASME B107.1-1993. In this configuration, the hardware portion 11 is pivotally attached to the drive portion 13.

It will be understood that a person skilled in the art may make modifications to the preferred embodiment shown herein within the scope and intent of the claims. While the present invention has been described as carried out in a specific embodiment thereof, it is not intended to be limited thereby, but is intended to cover the invention broadly within the scope and spirit of the claims.

What is claimed is:

1. A socket adapted to torque a head of a hardware fastener, the hardware fastener having a predetermined size and an associated counter bore with a predetermined diameter per SAE Standard cited as: "Wrench Clearance, Table 3, SAE Aeronautical Drafting Manual, 1954 edition, page Y4.04", the socket comprising:

a drive portion adopted to engage a socket drive tool; and a hardware portion attached to the drive portion, the hardware portion including:

a metallic outer sleeve having an outside diameter which is sized to fit into the associated counter bore of the hardware fastener, and a non-marring inner lining disposed within the outer sleeve, the inner lining including a hardware torquing hole, located at a distal end of the socket, sized to fit over the head of the hardware fastener to provide torquing to the hardware fastener without marring the hardware fastener.

2. The socket of claim 1, wherein the socket has dimensions which substantially meet one of the standards ASME B107.1-1993 and ASME B107.5M-1994 for the size of the hardware to be torqued.

3. The socket of claim 1 wherein the inner lining substantially has an M scale hardness of at least 115.

4. The socket of claim 1 wherein the inner lining comprises a composite material.

5. The socket of claim 1 wherein the inner lining comprises one of the group consisting of NEMA Grade G-10 glass cloth epoxy and NEMA Grade G-3 glass cloth phenolic.

6. The socket of claim 1 wherein the inner lining is has a cross sectional shape configured as one of the group consisting of a single hexagon, double hexagon, square and double square.

7. The socket of claim 1 wherein the predetermined size of the hardware fastener and the predetermined minimum counter bore diameter respectively are substantially equal to one of the pairs of hardware sizes and associated minimum counter bore diameters listed in the following table:

| Hardware size (inches) | Minimum Counter Bore Diameter (inches) |
|---|---|
| .188 | .370 |
| .250 | .470 |
| .312 | .550 |
| .344 | .580 |
| .375 | .620 |
| .438 | .750 |
| .500 | .810 |
| .562 | .870 |
| .594 | .920 |
| .625 | .950 |
| .688 | 1.030 |
| .750 | 1.120 |
| .781 | 1.150 |
| .812 | 1.200 |
| .875 | 1.280 |
| .938 | 1.370 |
| 1.000 | 1.470 |
| 1.062 | 1.550 |
| 1.125 | 1.610 |
| 1.250 | 1.890 |
| 1.312 | 1.980 |
| 1.438 | 2.140 |
| 1.500 | 2.200 |
| 1.625 | 2.390. |

8. The socket of claim 1 further comprising an extended portion extending outwardly from the distal end of the outer sleeve by a distance less than a thickness of the head of the hardware fastener.

9. The socket of claim 1 wherein the drive portion is adapted to engage one of the group consisting of a ¼ inch socket drive tool, a ⅜ inch socket drive tool and a ½ inch socket drive tool.

10. The socket of claim 1 wherein the drive portion has an outside diameter different than that of the hardware portion.

11. The socket of claim 1 wherein the drive portion and the hardware portion are pivotally attached.

12. A socket adapted to torque a head of a hardware fastener, the hardware fastener having a predetermined size, the socket comprising:

inside and outside dimensions which substantially meet one of the standards ASME B107.1-1993 and ASME B107.5M-1994 for the size of the hardware fastener to be torqued;

a drive portion adopted to engage a socket drive tool; and a hardware portion attached to the drive portion, the hardware portion including:

a metallic outer sleeve, a non-marring inner lining disposed within the outer sleeve, the inner lining including a hardware torquing hole, located at a distal end of the socket, sized to fit over the head of the hardware fastener to provide torquing to the hardware fastener without marring the hardware fastener.

13. The socket of claim 12 wherein the inner lining substantially has an M scale hardness of at least 115.

14. The socket of claim 12 wherein the inner lining comprises a composite material.

15. The socket of claim 12 wherein the inner lining comprises one of the group consisting of NEMA Grade G-10 glass cloth epoxy and NEMA Grade G-3 glass cloth phenolic.

16. The socket of claim 12 wherein the inner lining is has a cross sectional shape configured as one of the group consisting of a single hexagon, double hexagon, square and double square.

17. The socket of claim 12 further comprising an extended portion extending outwardly from the distal end of the outer sleeve by a distance less than a thickness of the head of the hardware.

18. The socket of claim 12 wherein the drive portion is adapted to engage one of the group consisting of a ¼ inch socket drive tool, a ⅜ inch socket drive tool and a ½ inch socket drive tool.

* * * * *